US006658799B1

(12) United States Patent
Stoodley

(10) Patent No.: US 6,658,799 B1
(45) Date of Patent: Dec. 9, 2003

(54) VOLUMETRIC MODULAR BUILDING SYSTEM

(76) Inventor: William Richard Charles Stoodley, 3 Beechwood Gardens, Slough, Berkshire SL1 2HW (GB)

( * ) Notice: Subject to any disclaimer, the term of this patent is extended or adjusted under 35 U.S.C. 154(b) by 0 days.

(21) Appl. No.: 09/807,862

(22) PCT Filed: Oct. 19, 1999

(86) PCT No.: PCT/GB99/03519

§ 371 (c)(1),
(2), (4) Date: Apr. 19, 2001

(87) PCT Pub. No.: WO00/23666

PCT Pub. Date: Apr. 27, 2000

(30) Foreign Application Priority Data

Oct. 20, 1998 (GB) ..... 9822784

(51) Int. Cl.[7] ..... E04H 1/00; E04H 14/00; E04H 3/00; E04H 5/00; E04H 6/00; E04H 9/00

(52) U.S. Cl. ..... 52/79.2; 52/745.21; 52/125.5; 52/125.4; 52/125.1; 52/79.11

(58) Field of Search ..... 52/79.2, 79.11, 52/79.13, 79.14, 125.1, 125.2, 125.3, 125.4, 125.5, 125.6, 126.4, 126.7, 745.19, 745.21, 745.12, 742.14, 745.01, 79.9

(56) References Cited

U.S. PATENT DOCUMENTS 3,703,058 A * 11/1972 Klett et al. ..... 52/579
3,724,141 A * 4/1973 Kelleher ..... 52/125.4
3,742,660 A 7/1973 Bierweiler
3,792,558 A * 2/1974 Berce et al. ..... 206/321
3,952,465 A 4/1976 Masiello
3,952,474 A 4/1976 Rice
4,136,492 A * 1/1979 Willingham ..... 52/30
4,147,009 A * 4/1979 Watry ..... 52/744
4,282,690 A * 8/1981 Meheen ..... 52/79.11
4,432,176 A * 2/1984 Balzer ..... 52/169.7
5,081,805 A * 1/1992 Jazzar ..... 52/79.2
5,203,707 A * 4/1993 Musto et al. ..... 434/226
5,402,618 A * 4/1995 Biffis et al. ..... 296/35.3
5,493,817 A * 2/1996 Speer ..... 220/1.5
5,845,457 A * 12/1998 Wybauw ..... 249/83
6,367,205 B2 * 4/2002 Cornett, Sr. ..... 52/223.13

* cited by examiner

*Primary Examiner*—Carl D. Friedman
*Assistant Examiner*—Chi Q Nguyen
(74) *Attorney, Agent, or Firm*—Kriegsman & Kriegsman

(57) ABSTRACT

A volumetric modular building system comprising a reinforced concrete inverted "tee-beam" module. The module has a series of integral cross-walls which are spaced to coincide with the dimensions of the rooms and corridors constituting a section of a building, these rooms being formed by a matched pair of such modules acting in parallel, separated by, and adapted to support between them, a suspended concrete floor, external infill walls, internal partition walls, fixtures and services. The dimensional control of the modules is ensured by means of a removable structural steel framework gauge attached to and forming a part of the casting mold adjacent to the ends of the integral cross-walls. The legs of the gauge serve to locate and secure, during casting, top and bottom steel bearing-plates which are in turn separated, regulated and perforated by vertical steel tube tie-rod sleeves embedded locally near the ends of the concrete cross-walls.

10 Claims, 9 Drawing Sheets

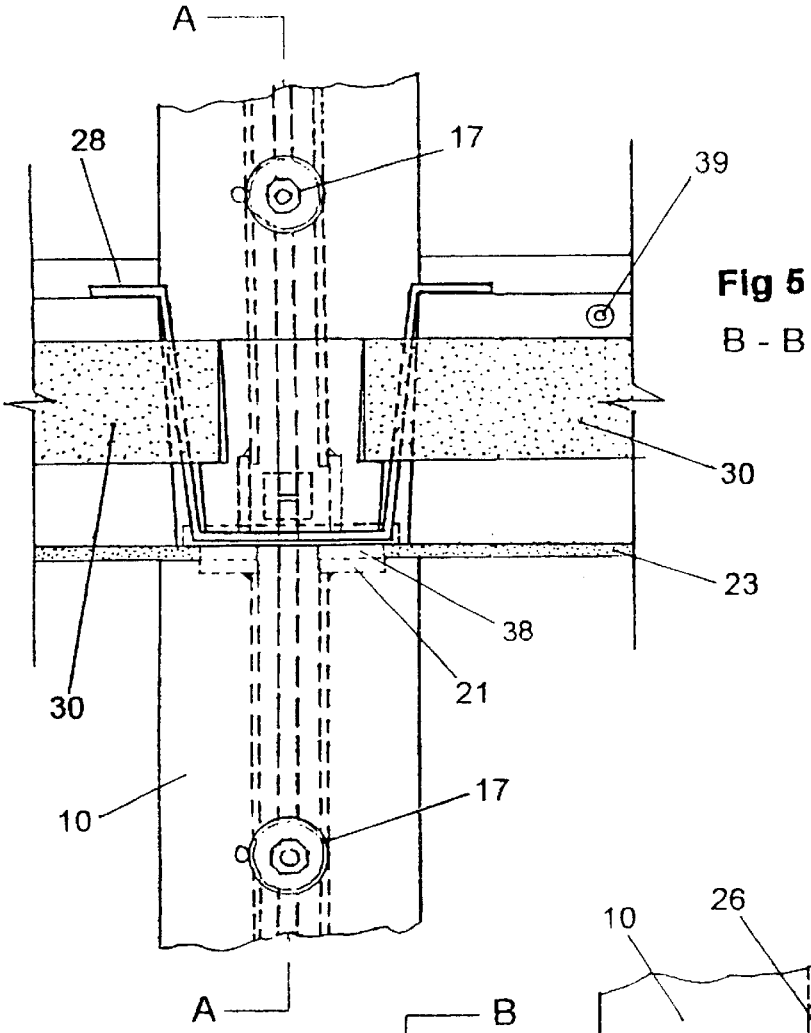
Fig 5
B - B
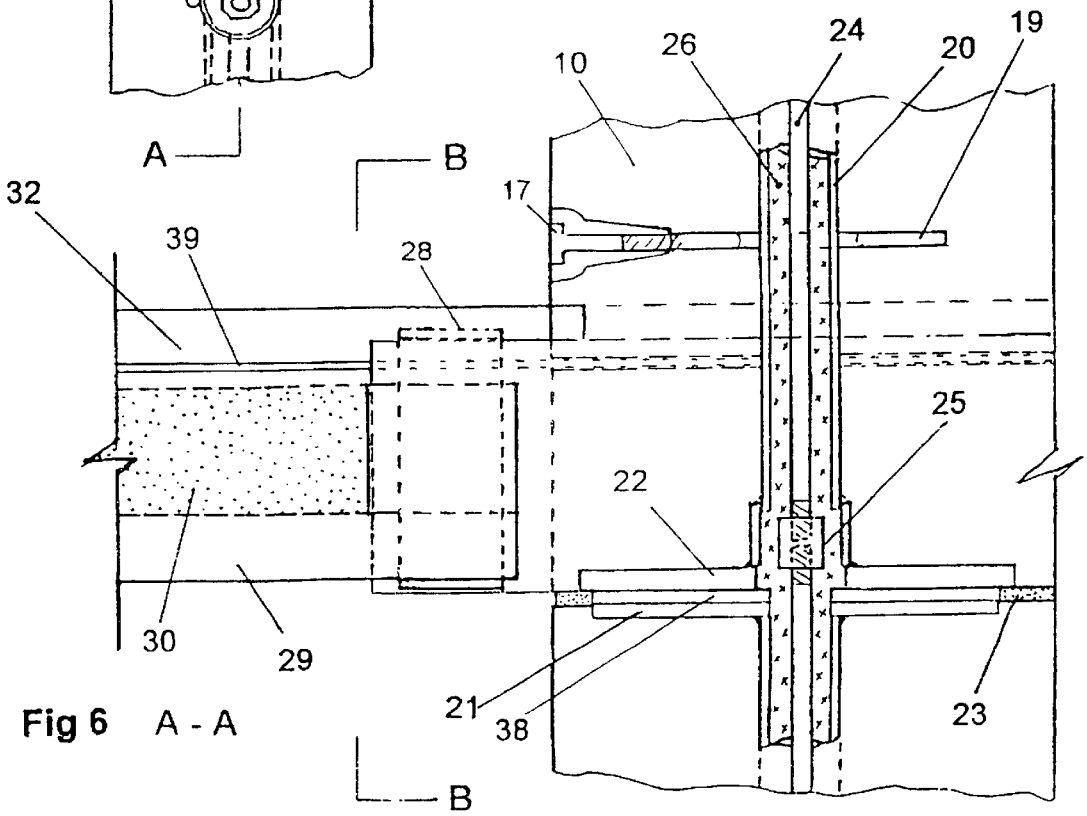
Fig 6 A - A

C - C

VOLUMETRIC MODULAR BUILDING SYSTEM

BACKGROUND OF THE INVENTION

This invention relates to a volumetric modular building system.

Volumetric modular building systems are well known methods of construction which utilize the benefits of industrialization, prefabrication and standardization in the structural form of component modules and also incorporate a substantial amount of finished works into their production before transport and erection on site.

The design size of each habitable volumetric module is determined by eventual use and also by handling, transporting and lifting considerations. Moreover the design of structural connections and the geometry of horizontal and vertical joints between such modules are both governed by tolerances that can be achieved for the dimensions of individual modules.

Special arrangements for handling, lifting or transporting volumetric modules may be required if they are too heavy or over-size for normal road, rail or sea transport thus preventing their use due to excessive cost.

The use of slender sections or lightweight materials in order to overcome module size or weight restrictions may, for example, cause stress concentrations leading to long-term structural weakness, or perhaps involve excessive production or maintenance costs.

According to the present invention there is provided a volumetric modular building system comprising a reinforced concrete inverted 'tee-beam' module having a series of integral cross-walls which are spaced to coincide with the dimensions of the rooms and corridors constituting a section of a building, these rooms being formed by a matched pair of such modules acting in parallel, separated by, and adapted to support between them, a suspended concrete floor, external infill walls, internal partition walls, fixtures and services. There may preferably be provision for any number of matched pairs stacked side by side, end on end or one upon another producing buildings from one to ten stories in height under a single roof.

SUMMARY OF THE INVENTION

The dimensional control of reinforced concrete inverted 'tee-beam' modules is ensured by means of a removable structural steel framework gauge attached to, and forming part of the casting mold adjacent to the ends of the integral cross-walls described above. The legs of the gauge serve to locate, and secure during casting, top and bottom steel bearing-plates which are in turn separated, regulated and perforated by vertical steel tube tie-rod sleeves embedded locally near the ends of the concrete cross-walls.

The 'primary' legs of the gauge, being attached to 'primary' crosswalls, provide the means by which modules are fastened and secured for safe handling and transport, and also during the sequence of lifting, positioning and fixing operations at the site. To achieve standardization in length within the range of module sizes and in order to ensure simplicity and economy of the handling and installation operations, the spacing in plan, between the outside faces of primary gauge legs is prescribed to be the same as the overall length of a standard ISO Series 1 freight container.

The 'primary' gauge leg 'corner structure' is designed in accordance with ISO specifications for such containers and the attachment, by welding, to 'corner fittings' in accordance with ISO 1161(BS3951:Part1:1985) and the relevant ISO standards for testing such containers. This is in order to facilitate top 'twist-lock' loading and the transfer and fastening of the modules onto skeleton trailers and flat-bed railcars, or for handling and stacking of modules either at the fabrication plant, the dockside or within container ships.

Module width is confined between the extremities of installed gauge legs also being prescribed as that for standard ISO containers, namely 8 ft 0 ins. (2438 mm.)

Module height , being fractionally shorter than the height of gauge legs, is preferably the same as, but not limited to that as for Series 1AA or 1CC ISO freight containers having a nominal height of 8 ft 6 ins. (2591 mm.).

Similar gauge legs are fixed at the ends of other crosswalls prior to concrete casting, however, these 'secondary' gauge legs have plain ends without corner fittings. They can be used as fenders whilst modules are in transit, but since they are not used for lifting purposes they can be disconnected before each module is installed. The exposed parts of the embedded fixings can be used to support infill panels and certain precast concrete suspended floor elements.

Before lifting, a layer of fresh cementitious material is applied along the top concrete surface of foundation footings or previously-installed module walls to act as intermediate padding between the actual steel bearing-plates and shims which comprise the initial contact surfaces. Threaded tie-rods are inserted into all sleeves at the time of lifting and, during the subsequent positioning and lowering operations, they are connected to corresponding threaded couplings which serve as accurate guides atop previously-installed foundations or modules.

Local irregularities in the level of steel bearing-plates can be reduced or eliminated by interposing additional shims of suitable thickness, these being perforated to match the tie-rods as necessary. Tie-rods are tensioned and sleeves grouped, if required, in order to establish continuous vertical connections down through each module to bottom bearing plates, these having similar couplings anchored to the foundations.

Although site-cast reinforced concrete strip footings or pad foundations are generally suitable for low-rise buildings, concrete structures over four stories high maybe best suited to 'piled' foundations irrespective of prevailing soil conditions and site topography. The repetitious layout of modular buildings is particularly suitable for incorporating all the advantages of standardization, speed and versatility of precast concrete foundation elements and their use is preferred with this invention.

Loading from each floor level is considered to be transmitted down through the building via the structural cross-walls of the modules. Piles are to be installed to a common level as pairs, one pile under each end of each crosswall. Piles can either be the cased or uncased 'augured' type, or be of the 'driven' precast concrete or pre-formed steel variety.

A pair of piles, each positioned to an accuracy of 3" (75 mm.) in any direction in plan, is topped-out to a common level by an overlying voided precast concrete capping-beam, spanning between the two piles and enveloping any protruding steel plate connectors or cage reinforcement at the head of the piles, this being temporarily fixed and held in position during the addition of cementitious material which, after setting, serves to fill the voids and Integrate both piles and capping beam. Capping- beams are orientated to the best overall common alignment to suit the cross-walls.

The precast concrete foundation capping-beams have steel plates embedded at their upper surfaces central and adjacent to the projected cross-wall end positions. There are two holes, each offset from the crosswall centre-lines, through which the cementitious material can be introduced and compacted. After piling and capping-beam installation is satisfactorily completed, the steel embedment plates are accurately surveyed for the precise positioning and welding of threaded couplings.

Secondary precast concrete 'connecting-beams', spanning between the mid-points of capping-beams are designed to prevent any relative movement between the pairs of piles and reinforce the modules under the position of the spine-walls situated centrally between each of the cross-walls. Capping-beams are recessed having a horizontal steel plate embedment to suit the bearing and jointing of 'connecting-beams' by means of welded connections to matching steel angle embedments at the underside of each end. Longitudinal continuity between pile caps can be improved via steel tendons threaded through central ducts embedded within, and anchored at each end of abutting 'connecting beams'.

Modules are composed of solid, dense reinforced concrete designed in accordance with BS 8110:Part1:1997 cast with fixings, embedments and other sleeves designed to accommodate peripheral and intermediate tendons which are necessary to prevent disproportionate collapse, externally applied insulated render, 'in-wall' heating/cooling pipes and other mechanical and electrical equipment which is to be installed either in the factory or at site.

Suspended concrete floors spanning between module pairs are either made from traditional reinforced concrete cast on site with reinforcement continuity connections embedded within the opposing faces of module floors, or by adapting the module floor edges to accept the well-known 'precast beam and block' ('double-tee' or similar) method of floor construction.

For the insitu reinforced concrete suspended floor slab application, the formwork edges of inverted 'tee-beam' floors are either cast with female threaded rebar connectors attached, or have reinforcement starter bars simply cast-in at floor edge faces and later exposed and bent out after the erection of modules in order to provide laps for the suspended floor slab reinforcement.

In order to accommodate a 'precast beam and block' ('double-tee' or similar) floor at each level, manufactured edges of inverted 'tee-beam' module floors are formed with a series of crenellated wedge-shaped pockets into which steel hangers can be fixed in order to provide support for the beam ends. Adjacent hangers can be joined together with welded straps for extra security if required.

For 'precast beam and block' floors, blocks are installed onto the beam ledges and a sand/cement grout is brushed into the joints.

Peripheral and intermediate tendons are fed through their respective sleeves within the module floors and across the suspended floors prior to a sequence of tensioning and fastening operations. By this means, modules are effectively tied together at the periphery and internally at every floor level.

During the subsequent application of cementitious screed material over each of the suspended floors, the small gaps between the ends of precast beams, blocks, hangers and wedge-shaped pockets are filled and packed with mortar to improve security and protect the otherwise exposed steel hangers and tendons. 'Suspended floor 'fire rating' may be enhanced by the application of an intumescent covering or coating over the otherwise exposed parts of supporting hangers or the provision of a plasterboard ceiling.

External infill walls, comprising insulated panels, doors and window units are craned into position only after suspended floor elements have been fixed at each level, and also prior to the addition of another tier of modules.

Ceilings for the top tier of modules are integrated into the insulated roof assembly, this being fixed by way of structural connection to upper bearing plates.

The completion of thermal insulation, drainage membranes and wearing surfaces applying to module and suspended floor balconies is carried out under-cover once the roof is substantially complete.

All the above in accordance with current Building Regulations and British Standards.

BRIEF DESCRIPTION OF THE DRAWINGS

SUMMARY OF THE INVENTION

A specific embodiment of the invention will now be described by way of examples with reference to the accompanying drawings in which.

Figure 1:
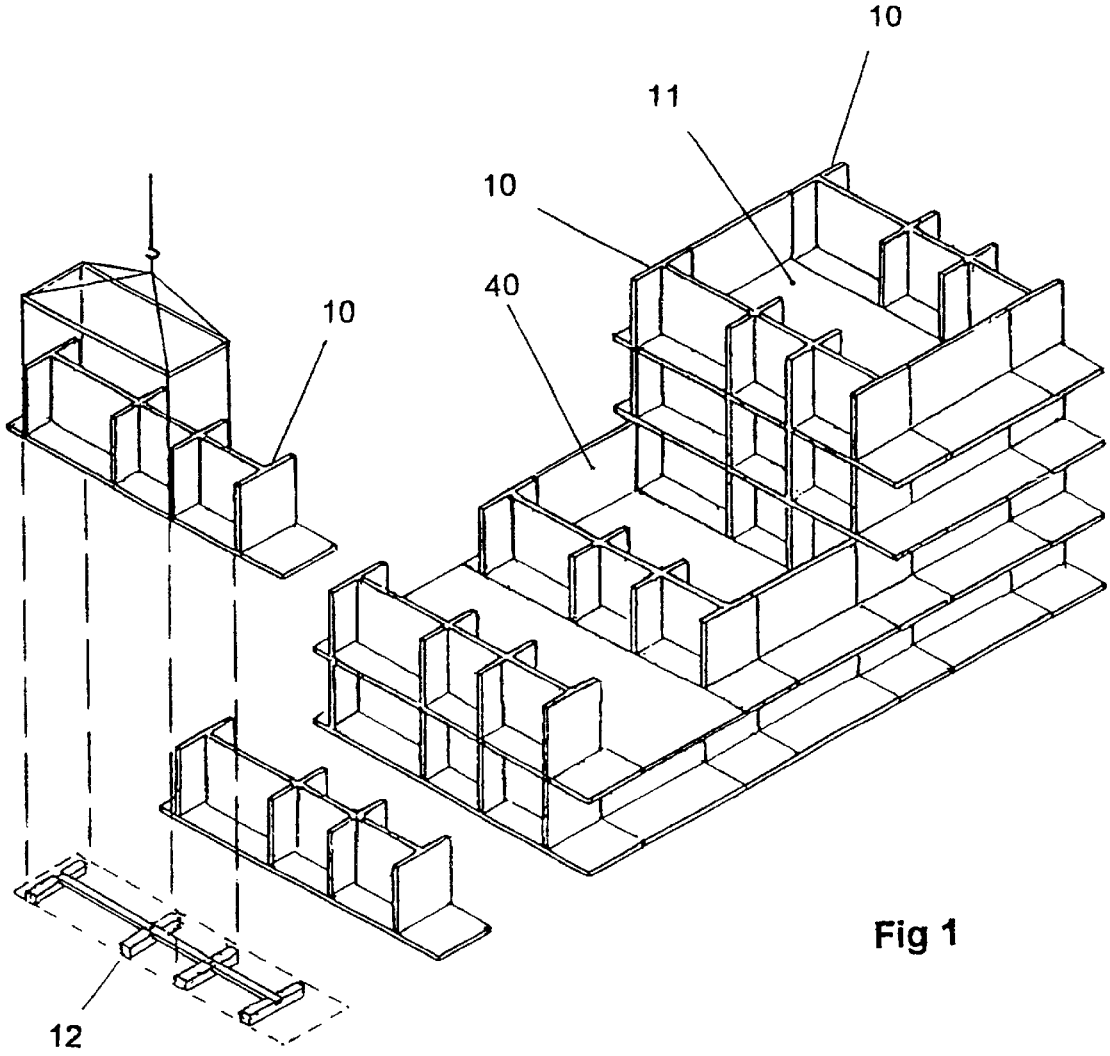

FIG. 1 illustrates in perspective, a 'stage by stage' schematic assembly of modules, suspended floors and infill panels (architectural 'Housing' details omitted for clarity)

Figure 2:
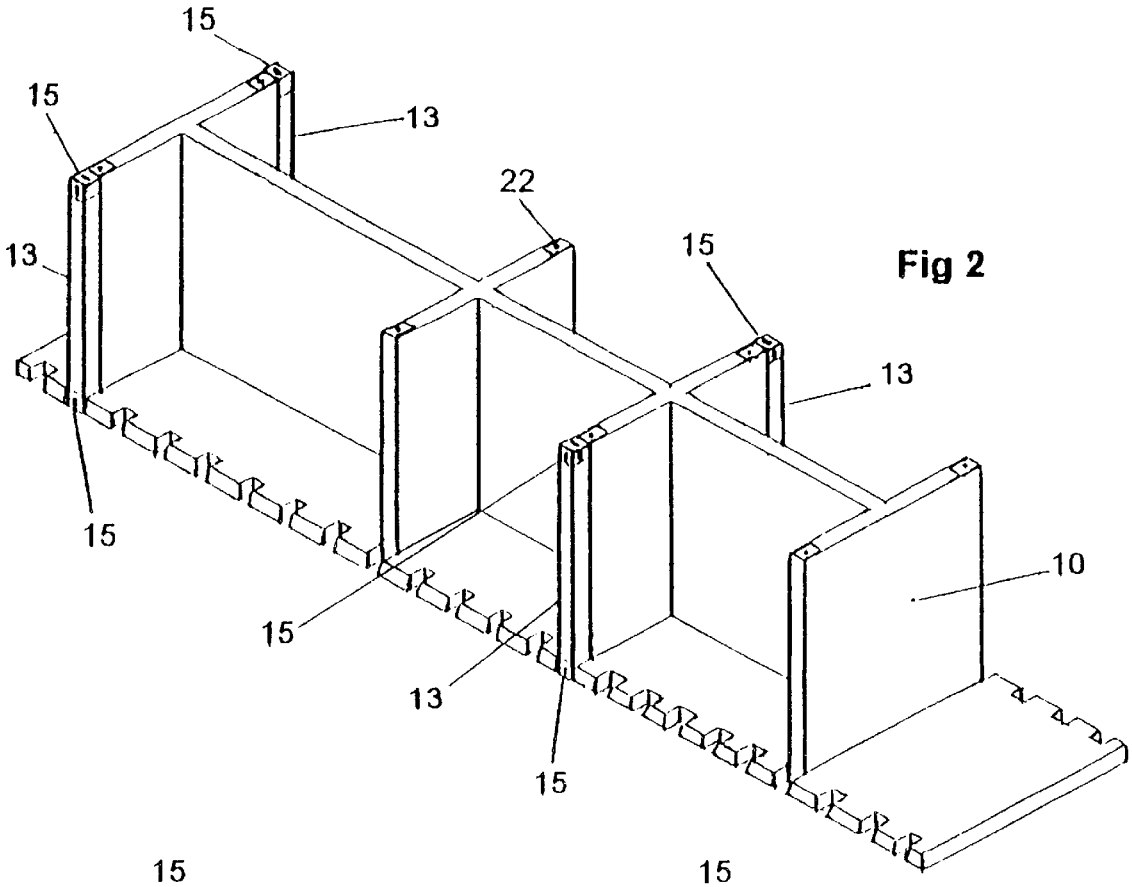

FIG. 2 shows in perspective a module having crenellated floor edges and primary gauge legs attached.

Figure 3:
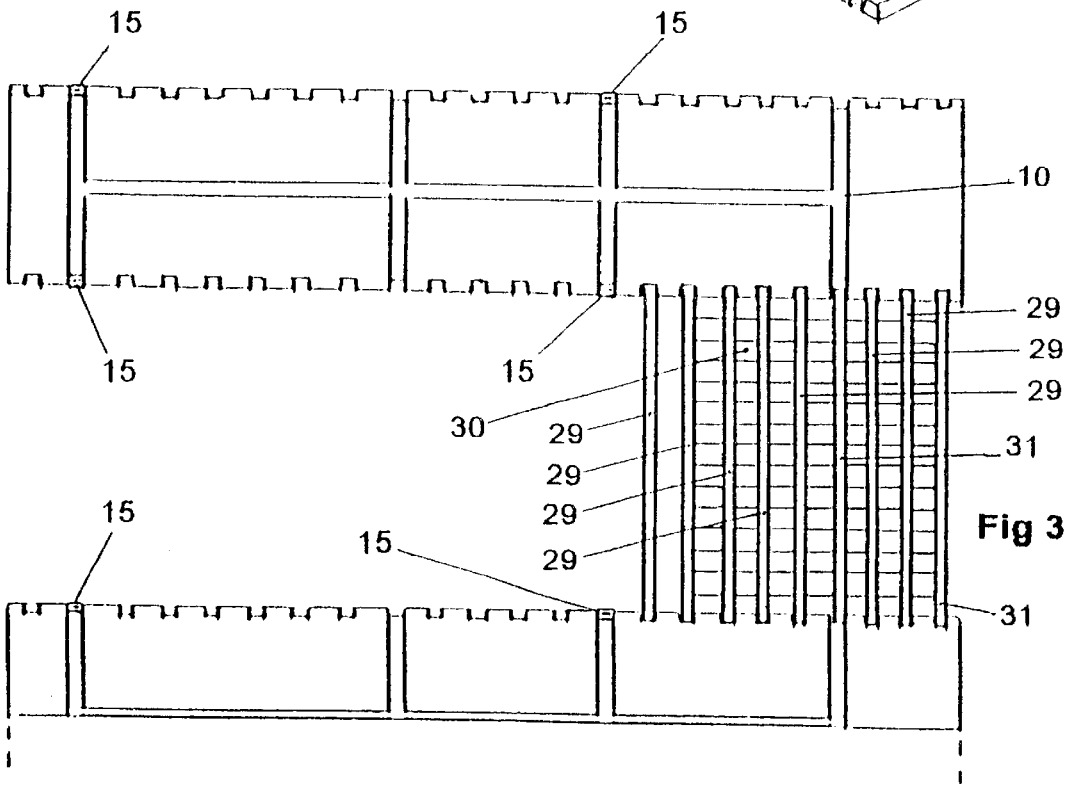

FIG. 3 illustrates in plan a pair of modules with the partial installation of 'beam and block' flooring elements prior to primary gauge leg removal and screed overlay.

Figure 4:
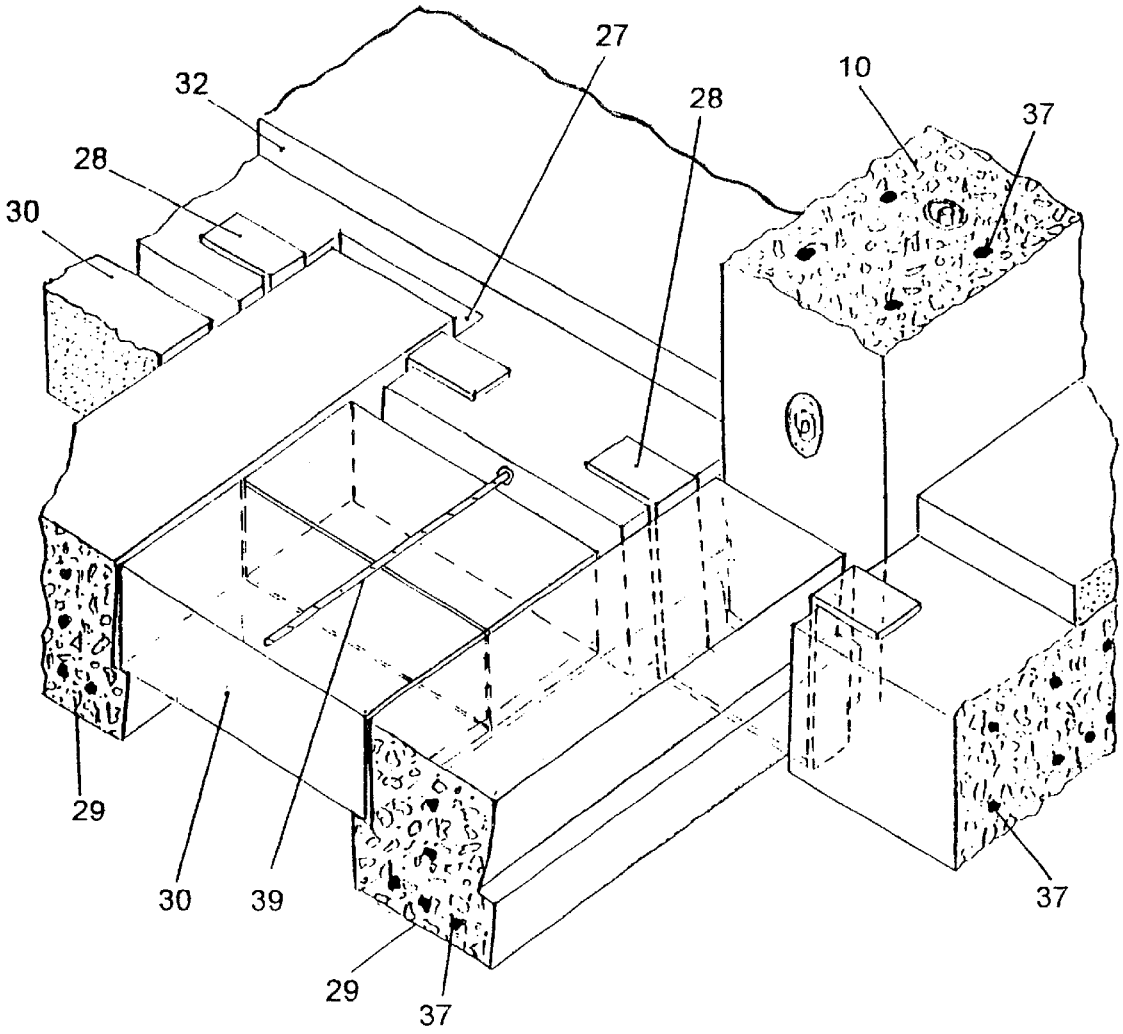

FIG. 4 shows in perspective a section of crenellated module floor with supports for 'beam and block' suspended floor elements.

FIG. 5 shows a sectional elevation through 'beam and block' floor elements being supported inside wedge-shaped pockets on steel hangers.

FIG. 6 shows a sectional elevation through a crosswall edge with the arrangements for module bearing plates, shims, tendon sleeves, tie-rods, gauge leg fixings and floor screed overlay.

Figure 7:
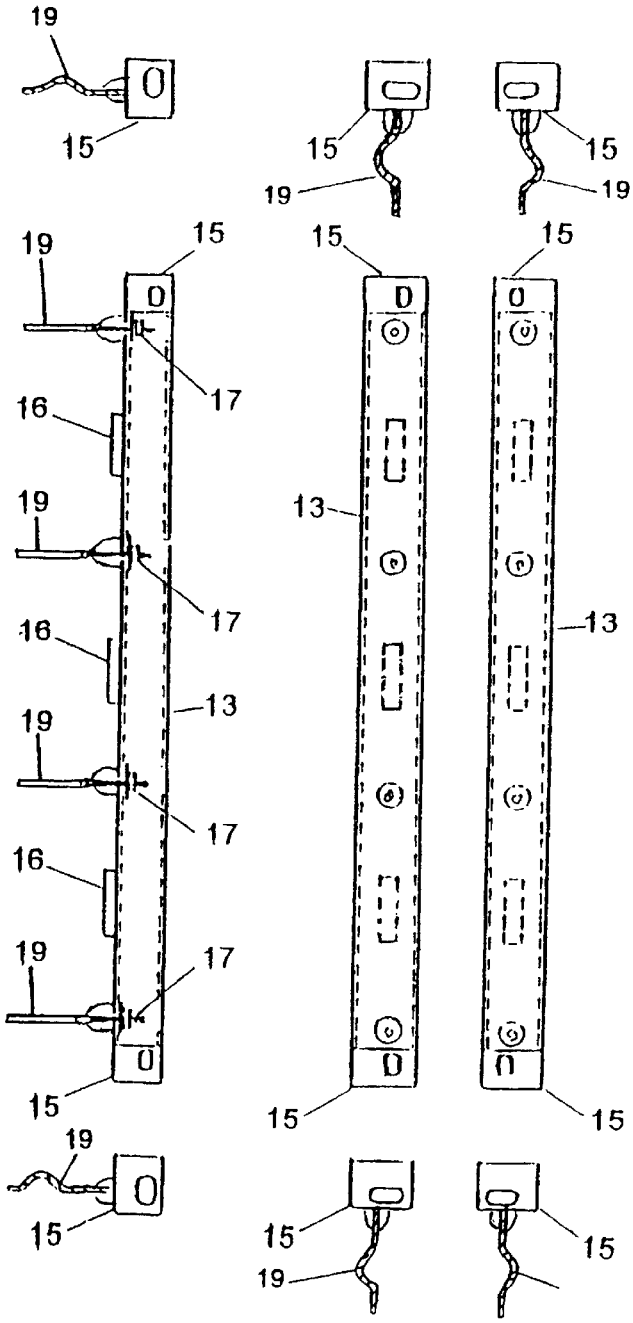

FIG. 7 shows the detail of 'left & right hand' primary gauge legs in front and side sectional elevations, and as viewed in plan and from below.

Figure 8:
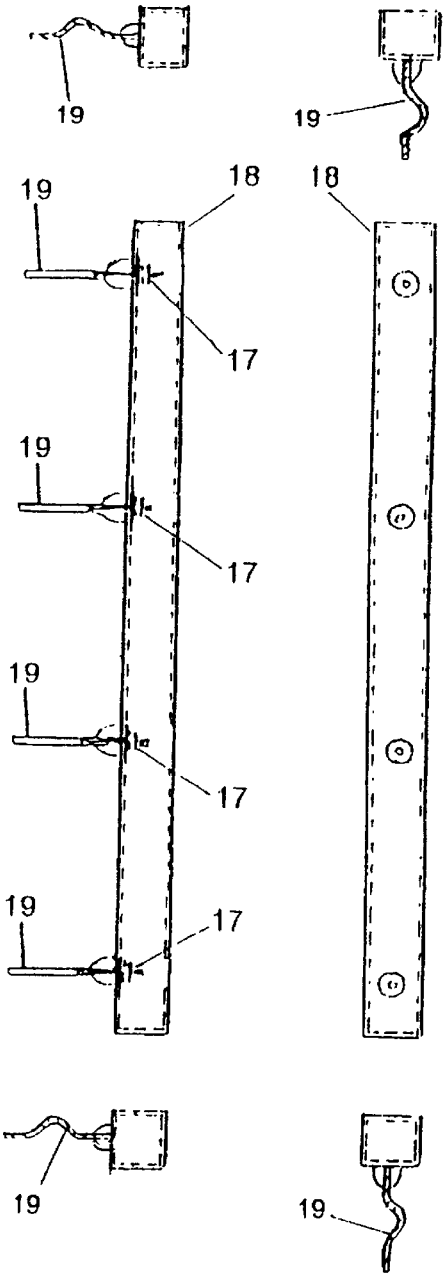

FIG. 8 shows the detail of secondary gauge legs in side & front sectional elevations and as viewed in plan and from below.

Figure 9:
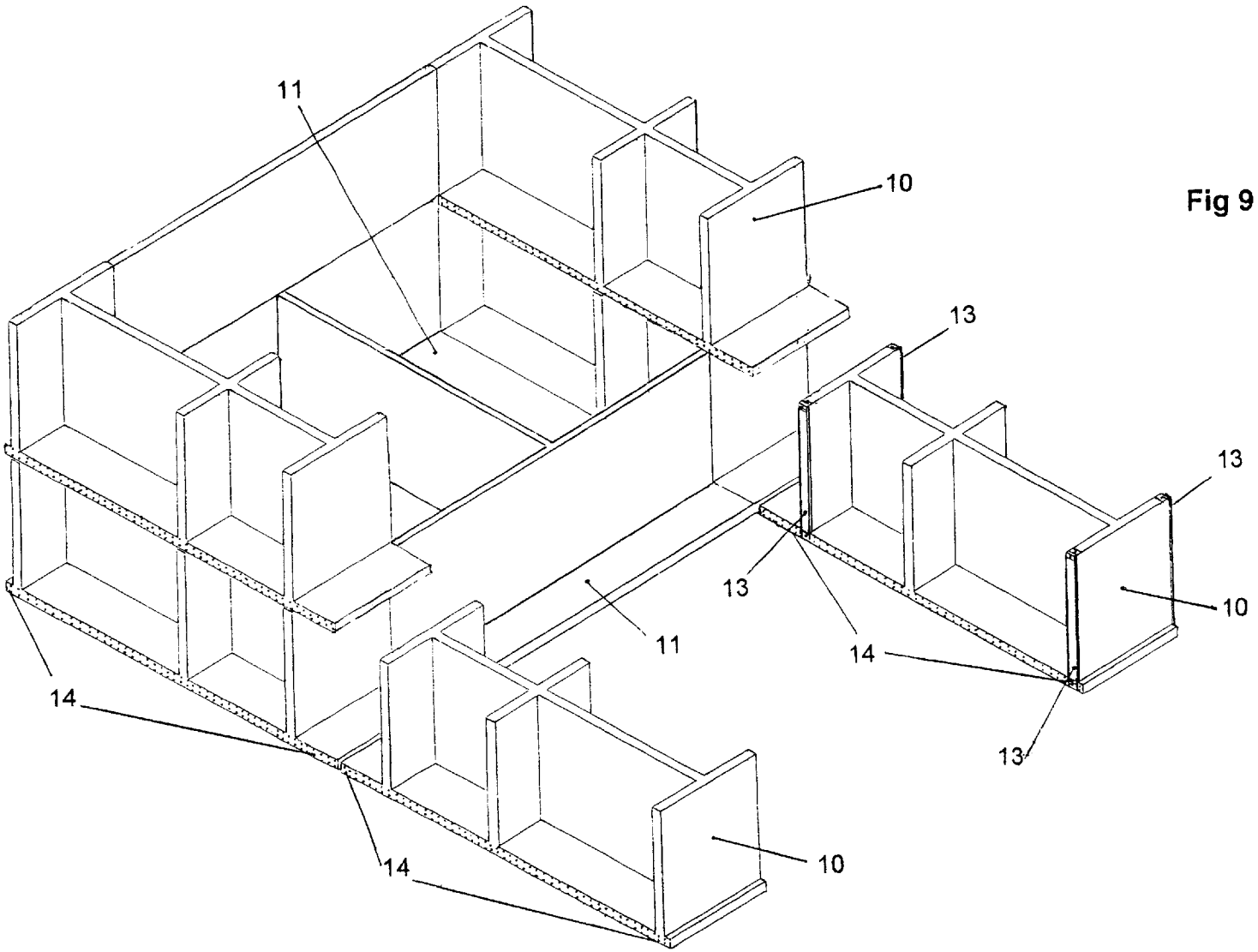

FIG. 9 shows in perspective a schematic for 'end on end' matched pair assembly of modules, infill panels and walls designed for 'site-cast' suspended slabs using female threaded reinforcement connectors (architectural 'Hotel' details omitted for clarity)

Figure 10:
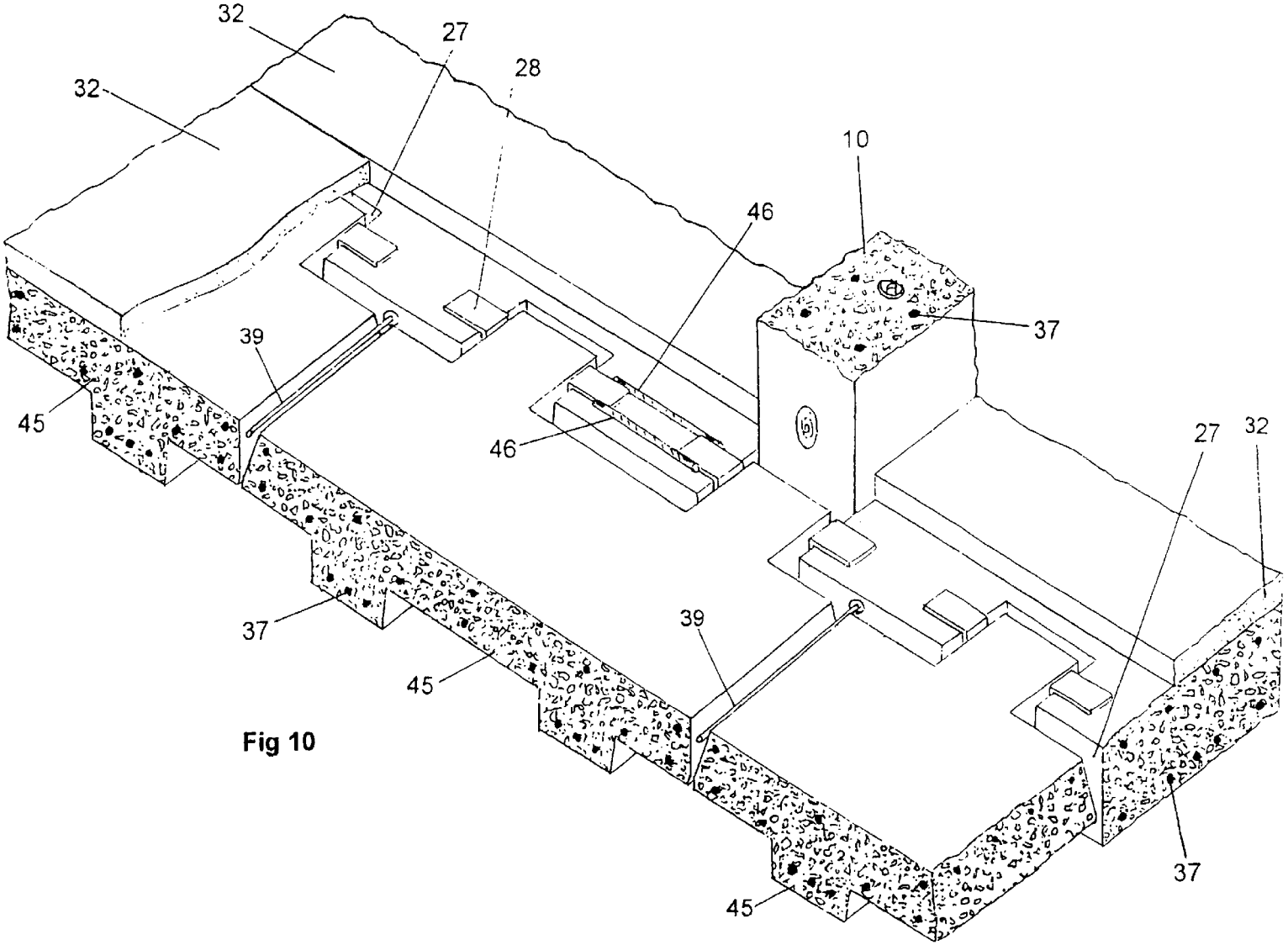

FIG. 10 shows in perspective a section of crenellated module floor with supports for 'double-tee' (or similar) suspended floor elements.

Figure 11:
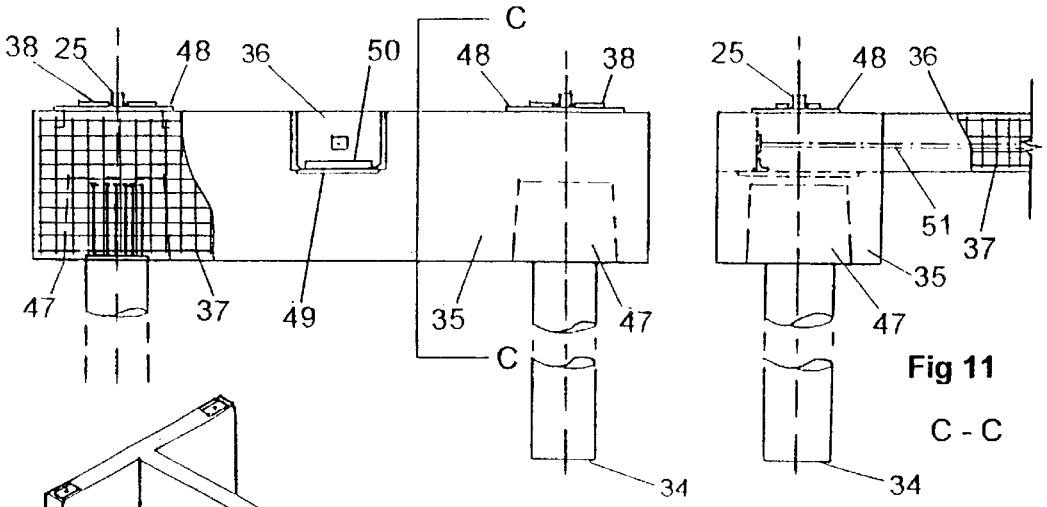

FIG. 11 shows the assembly of piled foundation elements in end view and also in sectional elevation.

Figure 12:
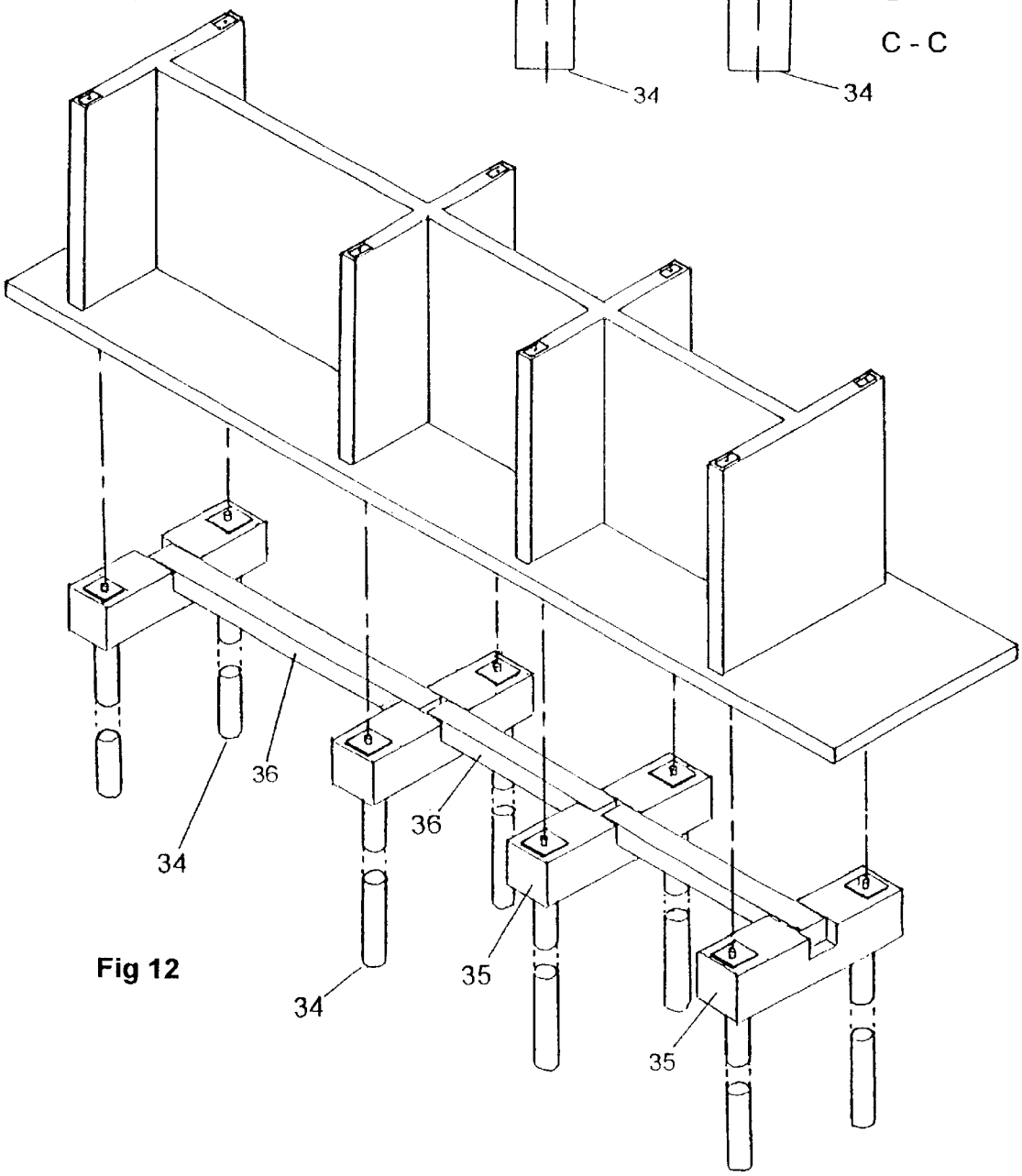

FIG. 12 shows the arrangement of piled foundations in perspective.

Figure 13:
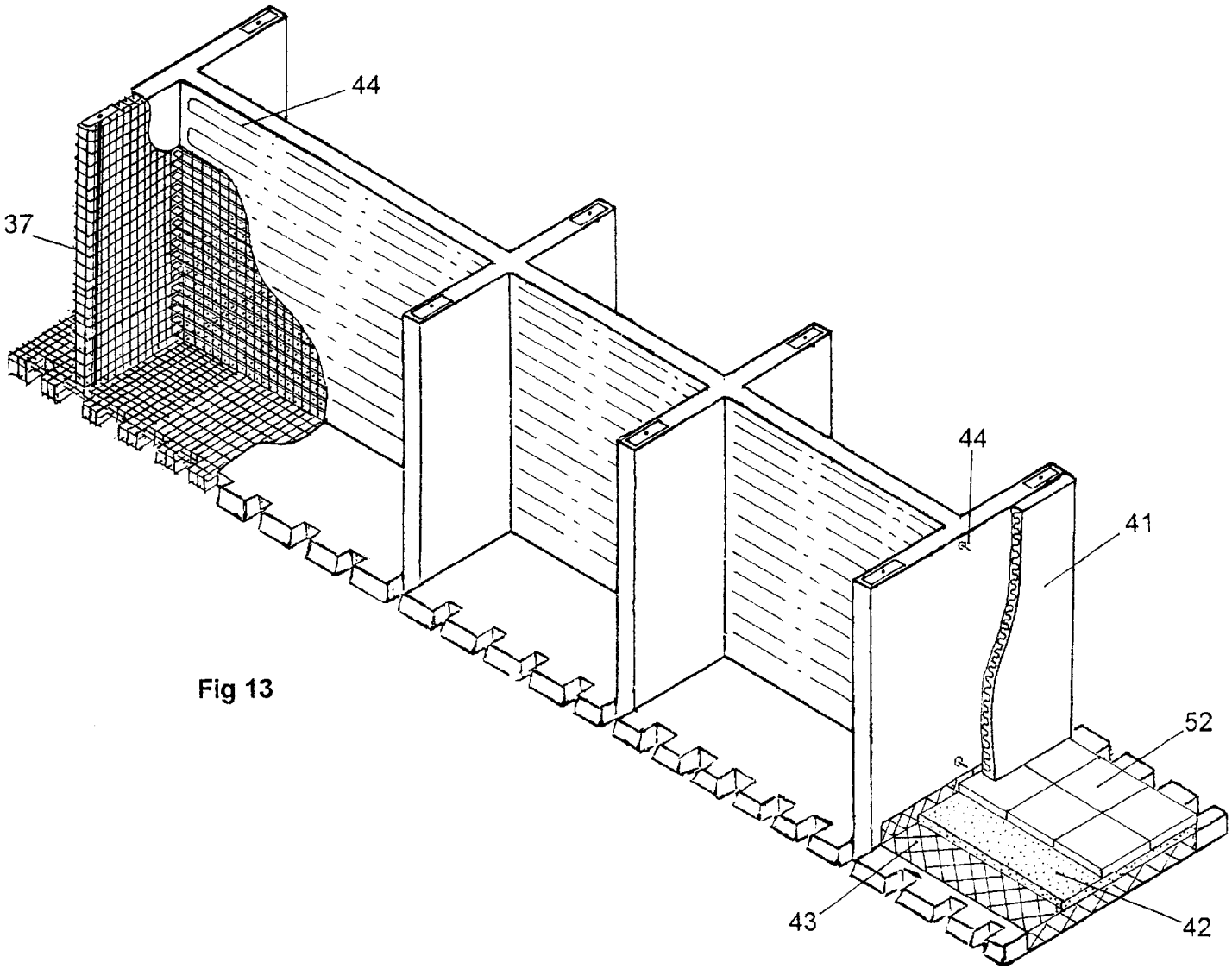

FIG. 13 shows the general composition of modules, insulation, balcony finishes and heating/cooling pipes.

DETAILED DESCRIPTION OF PREFERRED EMBODIMENTS

Referring to the drawings the volumetric modular building system comprises a matched pair of reinforced concrete inverted tee-beam modules with integral crosswalls 10, a suspended concrete floor assembly 11 and infill panels 40.

In order to lift, transport and install modules, primary crosswalls are fitted with four removable primary gauge legs 13 configured, in plan, to resemble a standard ISO freight container. Each primary gauge leg 13 comprises a rectangular hollow steel section with a structural 'corner casting' 15 in accordance with ISO-1161-1976, welded at each end. Plate shear connectors 16 are we welded to inside faces for extra strength and security during lifting.

Secondary gauge legs 18, having plain ends, are similarly affixed to the outside edges of remaining crosswalls during manufacture in order to locate bearings and tie-rod sleeves and also to control forwork geometry.

All gauge legs have provision for threaded nut and bolt attachment of 'cup and cone' formwork ties 17 which are connected to waved and threaded rebar anchors 19 cast permanently within the ends of the concrete crosswalls. Before casting, anchors 19 are spot-welded to each vertical tie-rod sleeve 20 which support the top and bottom bearing plates 21 & 22 respectively. All cups, cones and gauge legs are eventually removed for re-use.

The means of regulating, securing and fixing the modules in position, one upon another or onto foundations 12, is achieved through bedded bearings comprising the top and bottom steel bearing plates 21 & 22, shims 38, and intermediate cementitious mortar padding 23. The vertical tie-rods 24 are progressively jointed during loading operations using threaded couplings 25 and are later tensioned and grouped 26, if required.

Module floor edges have notched wedge-shaped pockets 27 formed in order to accommodate steel hangers 28 which support precast beams 29 ('double-tee' or similar floor elements 45) and concrete block insertions 30. Precast beams of deeper section 31 are used for room thresholds, balcony and walkway edges having welded steel hanger connectors 46.

After all precast elements are installed, screed material 32 is laid over the entire suspended floor thereby covering peripheral and intermediate tendons 39, and filling gaps between wedae-shaped pockets, steel hangers. blocks and beams.

Another example of module floor construction with wider suspended floors of deeper section with female threaded reinforcement connectors 14 for a 'cast-in-place' concrete floor is shown.

The precast concrete foundation arrangement 12, comprises 'augured or driven piles' 34, precast concrete capping beams 35, the secondary precast concrete connecting-beams 36 and welded threaded couplings 25.

Capping beams comprise plain reinforced concrete with a pair of cone-shaped voids 47 at their under-sides. Top extremities have embedded steel plates 48 which serve as the initial bearing surfaces for the modules and intermediate shims 38. A central rebate has a steel plate embedment 49 acting as a bearing for, and weld attachment to, the connecting-beam corner steel angle 50. Connecting beams each have a duct 51, cast in along a central axis to accommodate stressed tendons for longitudinal continuity.

Modules, suspended floor and foundation elements are composed of monolithically-formed dense concrete and high-tensile steel reinforcement 37 and the various embedments for structural integrity described above.

Additional features are 'external insulated render' 41, balcony insulation 42, tiles 52 and waterproofing 43, and the 'in-wall' embedded pipework for the heating/cooling system 44.

What is claimed is:

1. A cast reinforced-concrete volumetric module of inverted tee-beam structure, said cast reinforced-concrete volumetric module comprising:

(a) a plurality of cross-walls, each of said cross-walls having a top and a pair of ends;

(b) a floor, the floor having floor edges that are cast with a plurality of crenellations for respectively receiving hangers supporting the ends of suspended-floor beams, said crenellations being wedge-shaped pockets in the floor edges;

(c) metal members embedded in the cast concrete and projecting from the ends of at least some of said cross-walls for use as anchors in lifting the module; and (d) elongate metal lifting-legs detachably secured to anchor members projecting from at least some of said cross-walls, said elongate metal lifting-legs defining a pair of end-extremities for the cross-walls detachably secured thereto;

(e) wherein the width of the module as defined between the outside faces of the elongate metal lifting-legs is 8 ft (2438 mm).

2. A module according to claim 1 wherein each elongate metal lifting-leg comprises (i) an elongate metal member of hollow rectangular section, said elongate metal member having a top and a bottom, (ii) a first corner fitting secured to said top of said elongate metal member, and (iii) a second corner fitting secured to said bottom of said elongate metal member.

3. A module according to claim 1 further comprising one or more plate shear connectors secured to the inside of each elongate metal lifting-leg to enhance lifting strength of the module.

4. A module according to claim 1 further comprising vertical tie-rod sleeves and top and bottom bearing plates, all of which are embedded in the cross-walls adjacent to the respective end-extremities of said cross-walls.

5. A module according to claim 4 further comprising threaded tie-rods inserted within the vertical tie-rod sleeves.

6. A module according to claim 4 wherein the anchor members are welded to the vertical tie-rod sleeves of their respective cross-wall ends.

7. A module according to claim 1 wherein only some of the cross-walls of the module that bear anchor members have elongate metal lifting-legs detachably secured thereto, said module further comprising elongate metal non-lifting-legs that are detachably secured to the remaining cross-walls that bear anchor members.

8. A module according to claim 7 wherein each of said non-lifting-legs comprises an elongate metal member of hollow rectangular section.

9. A module according to claim 1 further comprising a plurality of sleeves embedded in the floor of the module, said sleeves being adapted to receive horizontal tendons.

10. A module according to claim 1 further comprising pipework for a heating/cooling system embedded in the concrete.

* * * * *